US006005452A

United States Patent [19]

Ahlberg

[11] Patent Number: 6,005,452

[45] Date of Patent: Dec. 21, 1999

[54] FIXED TUNEABLE LOOP

[75] Inventor: Christer Ahlberg, Kolbäck, Sweden

[73] Assignee: Telefonaktiebolget LM Ericsson, Stockholm, Sweden

[21] Appl. No.: 08/993,784

[22] Filed: Dec. 18, 1997

[30] Foreign Application Priority Data

Dec. 20, 1996 [SE] Sweden ..... 9604701

[51] Int. Cl.[6] ..... H01P 5/04

[52] U.S. Cl. ..... 333/24 R; 333/202; 333/230

[58] Field of Search ..... 333/24 R, 24.2, 333/202, 227, 230

[56] References Cited

U.S. PATENT DOCUMENTS

| | | | |
|---|---|---|---|
| 3,214,684 | 10/1965 | Everitt | 333/24 R |
| 3,305,799 | 2/1967 | Levin | 333/24 R |
| 4,051,447 | 9/1977 | Heckman, Jr. | 333/24 R |
| 4,186,359 | 1/1980 | Kaegebein | 333/134 |
| 4,551,694 | 11/1985 | Biehl et al. | 333/230 X |
| 4,628,283 | 12/1986 | Reynolds | 331/68 |
| 4,896,124 | 1/1990 | Schwent | 333/206 |
| 4,896,125 | 1/1990 | Blair, Jr. et al. | 333/219.1 |
| 4,970,477 | 11/1990 | Gurcan et al. | 333/26 |
| 5,625,330 | 4/1997 | Wilson et al. | 333/230 |
| 5,739,733 | 4/1998 | Cameron | 333/212 X |
| 5,831,490 | 11/1998 | Sarkka et al. | 333/235 X |

FOREIGN PATENT DOCUMENTS

| | | |
|---|---|---|
| 0 197 653 | 10/1986 | European Pat. Off. . |
| 0 703 634 | 3/1996 | European Pat. Off. . |

*Primary Examiner*—Seungsook Ham
*Attorney, Agent, or Firm*—Burns, Doane, Swecker & Mathis, L.L.P.

[57] ABSTRACT

The present invention relates generally to filtering in e.g. mobile telephony. A new input loop is introduced wherein the input loop is fixed in its physical relation to the H-field. One end of this input loop is arranged to form a capacitance or an inductance which is then used to adjust the location of the maximum current node in the loop. The adjustment of the position of this maximum current node thereby adjusts the bandwidth of the RF signal. The fixing of the loop has the advantage of simplifying the procedure for tuning the filter. It also has the advantage of reducing the number of tools required for tuning, thereby allowing for a reduction in size occupied by the filter and isolator arrangement, and a reduction in the cabling and materials used.

11 Claims, 5 Drawing Sheets

FIXED TUNEABLE LOOP

FIELD OF THE INVENTION

The present invention relates generally to the use of radio filters and combiners used in e.g., a mobile radio system, and more particularly to the input loops used in such filters and combiners.

RELATED ART

In FIG. 1 is shown a diagram of a section of a conventional mobile telephone system, including two radio-frequency ("RF") transmitters 10*a*–10*b*, two isolators 20*a*–20*b*, two filters or combiners 30*a*–30*b*, connecting cables 40*a*–40*b*, 41*a*–41*b*, 42, and a transmitter antenna 50. There can either be only one transmitter 10*a* isolator 20*a* filter 30*a* combination connected to each antenna 50, or two combinations, as shown here, or more than two, as indicated by the dashed lines 60.

Each of the different branches 10*a*–20*a*–30*a* and 10*b*–20*b*–30*b* is intended to transmit radio signals within different frequency bands. The combiners 30*a*, 30*b*, are therefore used to let the transmitted radio signals within the respective frequency band pass through.

The arrangement of the various elements of the system as shown in FIG. 1 are well-known in the art. Typically the various elements are separated in space and connected by connecting cables 40*a*–40*b*, 41*a*–41*b*, 42. The present invention more particularly focuses on the arrangement of the isolator 20*a*–20*b*, the filter 30*a*–30*b* and the connecting cable 41*a*–41*b* between the two.

In typical state of the art systems, the isolators 20*a*–20*b* are separated from the filters 30*a*–30*b* by cables 41*a*–41*b*. A more detailed example of this part of a state of the art system is shown in FIG. 2. An RF signal is sent from the transmitter 10 through a connector cable 40 to the isolator 20, and then through a connector cable 41 to the input connector 31 of a filter 30 or combiner. Typically a coaxial cable is used as the connecting cable 40 and 41 to connect the transmitter 10 to the isolator 20 and the isolator 20 to the input connector 31 of the filter 30.

Also shown is an input loop 32 which is mated to the connecting cable 41 by the input connector 31. This loop 32 is an inductive coupling loop whose coupling to the magnetic field ("H-field") of the filter 30 is determined by its orientation to the H-field. The filter 30 is tuned by rotating the input loop 32 in relation to the H-field which changes the coupling. Once the filter 30 is tuned, the input loop 32 must then be locked into position to prevent accidental movement of the input loop 32 during operation of the filter 30.

This locking is done by tightening the locking nut 33. However, rotation of the locking nut 33 by itself will also cause the connector nut 34, and therefore the input loop 32, to also rotate. Therefore a second tool must be used to hold the connector nut 34 while a first tool is used to tighten the locking nut 33. This method of tuning is cumbersome because it takes more time, more space, and the use of more tools than is necessary or optimal.

An example of a state of the art filter using such a coupling loop is shown in U.S. Pat. No. 4,896,125. However, this U.S. patent focuses on the use of notch resonators for filtering by band rejection, as opposed to the use of the present invention as a bandpass filter.

The tuning of the filter in this U.S. patent is performed by a combination of adjusting the position of the inductive coupling loop within the space of the filter and adjusting the variable capacitor. Changing the position of the loop changes the depth of the attenuation and the width of the notch, while adjusting the variable capacitor varies the symmetry characteristics about the notch.

This approach, as with other current approaches such as the one shown in FIG. 2, results in a bulky construction, since the tuning requires the input loop 32 to be rotated by rotating the connector 31 or by moving the input loop 32 itself. This process of tuning by moving the input loop 32 is awkward and requires more space and tools to accomplish the job.

Also, the input loop 32 is grounded at point G in FIG. 2 where the input loop 32 is attached to the body of the connector 31 of the filter 30. This means that the maximum current node in the input loop 32 is the point G where the input loop 32 is grounded. The maximum coupling against the H-field in the filter 30 is in this maximum current node. Having the maximum current node at the ground G may then make it necessary to use a very large input loop 32 to be able to couple the RF signal to the filter 30.

SUMMARY OF THE INVENTION

It can be seen that these present approaches present at least two problems. First, the construction is bulky, with the isolator 20 being connected to the filter 30 by a coaxial cable 41. Second, tuning of the filter 30 is at least partially accomplished by rotating the input loop 32 itself, which is awkward to accomplish and also creates a problem when autotesting, where it is necessary to rotate the connector 31 together with the input loop 32.

Accordingly, one object of the present invention is to eliminate the problems of adjusting the filter characteristics of a combiner filter among a plurality of combiner filters.

More specifically, an object of the present invention is to eliminate the problem of adjusting a combiner filter of the kind where an input loop is used as an inductive element which is rotated during the tuning of the filter.

Accordingly, another object of the present invention is to eliminate the problem associated with this rotation of the input loop during tuning of the filter.

Yet another object of the present invention is to provide a more compact construction of the isolator and filter combination wherein they occupy less space and use less cabling. The result will be a filter which is less expensive and easier to tune and test.

The present invention will also provide an easier method of tuning than having to physically rotate the input loop 32. Autotesting of the filter 30 will also be easier using the construction in the present invention.

Briefly described, the present invention provides an apparatus for fixing an input loop in a combiner filter and integrating the input loop with the isolator. A mechanically adjustable capacitance is provided, for example, a tuning screw. When the filter characteristic is to be varied, the inductive part represented by the connector loop is kept constant while the capacitance is varied. This fixing and integration provides several advantages: saving space by integrating these elements together, saving time by requiring fewer tools and space with which to tune the filter, and providing an easier method with which to tune the filter by adjusting the capacitance between the input loop and the ground or by adjusting the inductance between the input loop and the ground.

In the preferred embodiment of the present invention the input loop is fixed perpendicularly in relation to the H-field with a capacitance to ground, thereby providing maximum coupling while using the minimum amount of loop. Normally, the maximum current node in the input loop will occur at the point where the input loop is grounded, normally the body of the connector. The connector is grounded in the boxwall of the filter. In this preferred embodiment of the present invention there is created a capacitance between the ground and the input loop. This capacitance is adjustable by using a screw. As the capacitance is adjusted, the maximum current node is shifted in the input loop which changes the coupling with the H-field. This change in the coupling narrows or widens the bandwidth of the RF-signal passed by the filter.

Another embodiment of the present invention uses an inductance instead of a capacitance to adjust the coupling of the input loop with the H-field. A screw is again used, but to slide electrically conductive contacts along the length of the input loop, thereby changing its effective length in relation to the ground, and thereby changing its inductance. This change in inductance also shifts the maximum current node in the input loop which changes the coupling with the H-field. This change in the coupling also narrows or widens the bandwidth of the RF-signal passed by the filter.

Although the embodiments described above both use a screw to create a capacitance or inductance to tune the filter, other types of capacitance or inductance may also be used. The use of the screw especially provides a more convenient method for automatic testing by using robots to merely turn the screw. It also means that when tuning this fixed loop, only one tool is needed. This, in turn, means that less space is needed outside the filter, allowing the integration of the isolator with the filter, and thereby occupying less space and using less cabling.

BRIEF DESCRIPTION OF THE DRAWINGS

The present invention will now be described in more detail with reference to preferred embodiments of the present invention, given only by way of example, and illustrated in the accompanying drawings, in which.

DETAILED DESCRIPTION

Figure 1:
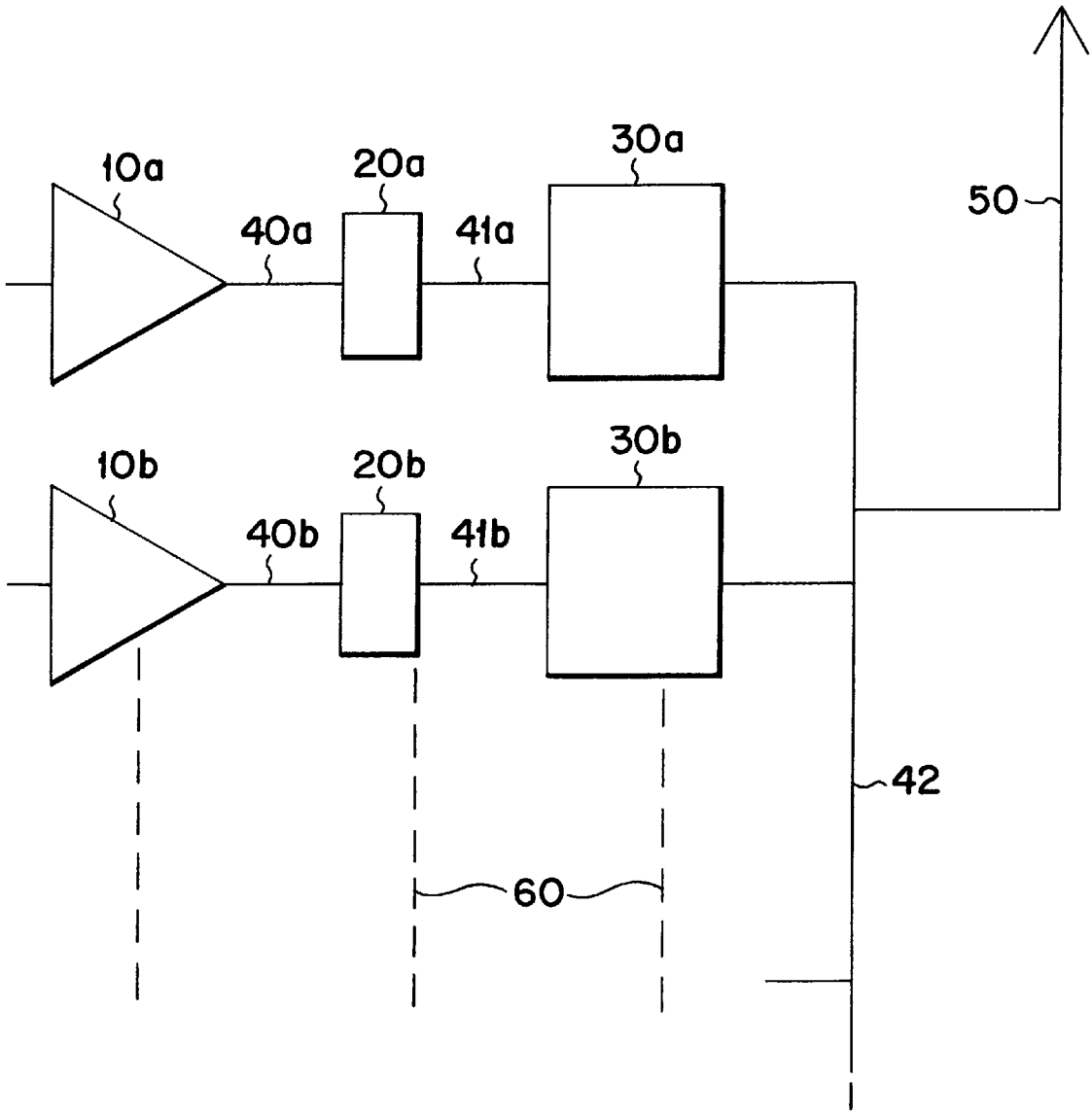
Fig. 1 PRIOR ART
FIG. 1 is a block diagram showing an overview of a mobile radio system where the present invention would be located.
Figure 3:
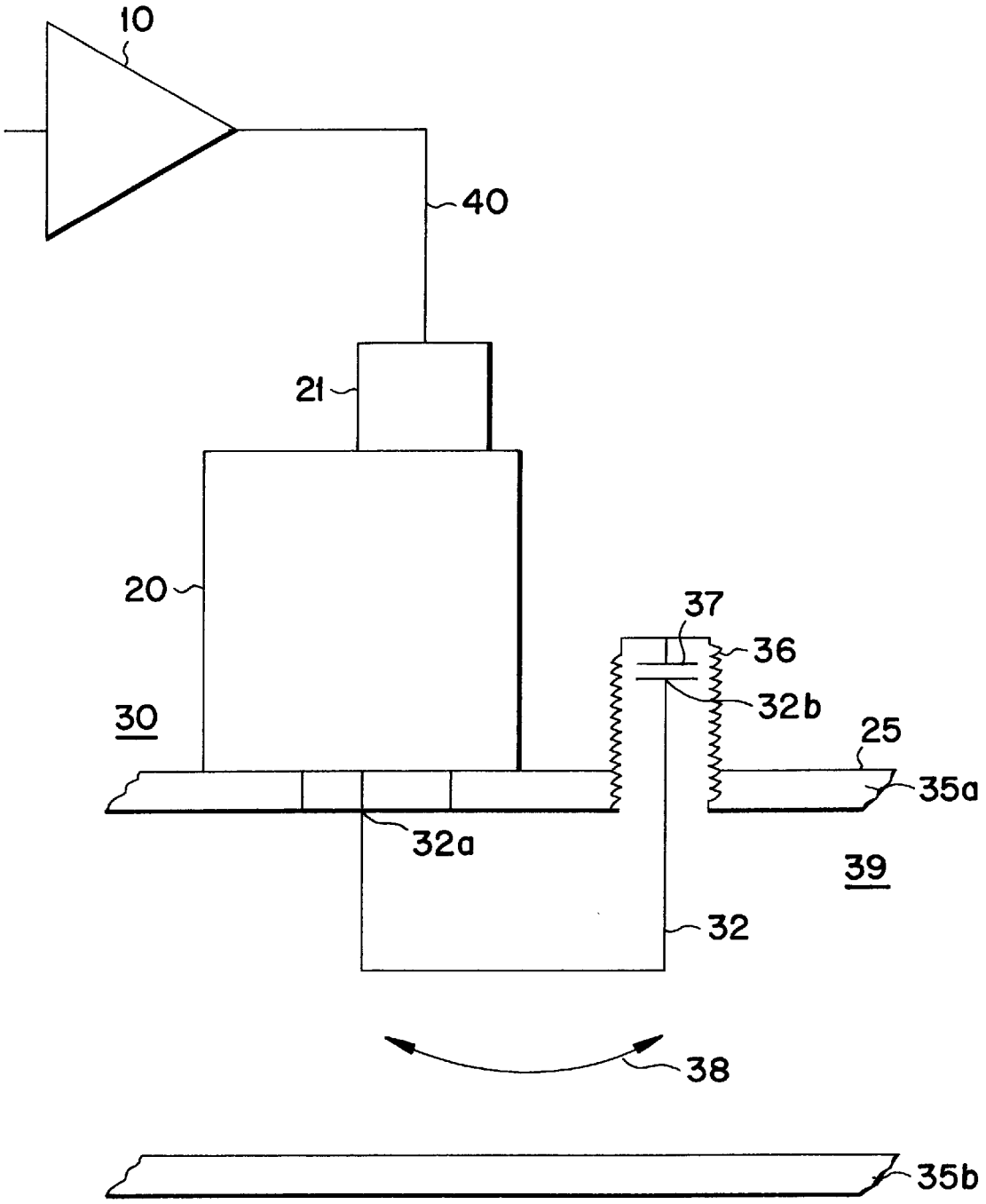
FIG. 3 schematically illustrates one embodiment of the present invention as used in a filter in a mobile telephone system.

In FIG. 3 is shown a schematic view of one embodiment of the present invention. An isolator 20 and a resonance filter 30 can be seen, which correspond to the isolator 20 and combiner filter 30 in e.g. a mobile radio system as shown in FIG. 1. A radio frequency input ("RF-input") 21 is mounted on the isolator 20. Typically, a coaxial cable 40 will be used to carry the RF signal from a transmitter 10 to the RF-input 21 on the isolator 20 as shown here.

The resonance filter 30 is formed by shaping a cavity 39 within upper and lower boxwalls 35*a*–35*b*. The boxwalls 35*a*–35*b* create a box within which the cavity 39 is formed in a method well-known in the art. The boxwalls 35*a*–35*b* have an electrically conductive surface. The inner material of the wall may be any material, e.g. plastic, but may be electrically conducting, just like the surface.

The shape of the boxwalls 35*a*–35*b* and cavity 39 are not part of the present invention. The cavity 39 is filled with a dielectric such as air, ceramic, or other suitable combination of dielectrics. The view here only shows a portion of the upper and lower boxwalls 35*a*–35*b* and the cavity 39 in order to show the physical relation to the inventive elements therein. The sidewalls and front and back walls are not shown.

Figure 2:
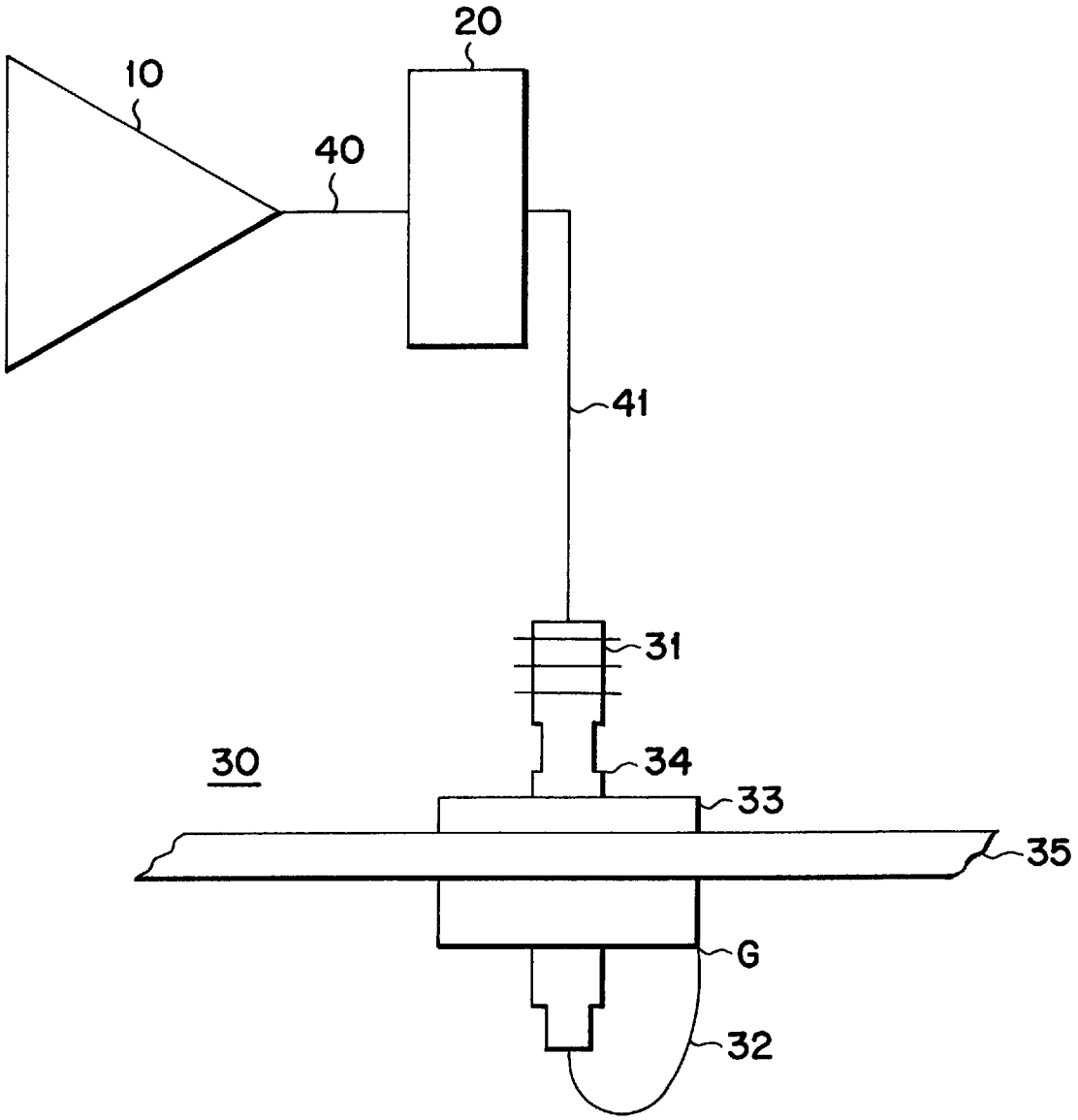
Fig. 2 PRIOR ART
FIG. 2 illustrates a cutaway view of a state of the art use of an input loop used for tuning the types of filters used in mobile telephone systems.

The isolator 20 is then attached to the outer surface 25 of the upper boxwall 35*a*. Whereas prior systems located the isolator 20 separately from the resonance filter 30, the present invention integrates both of them together, thereby eliminating the need for cabling between the isolator 20 and the filter 30. Also, the present invention can be compared to the prior system shown in FIG. 2, wherein the RF signal is carried from the isolator 20 to the loop 32 via a coaxial cable 41.

In the embodiment of the present invention shown in FIG. 3, the inductive loop 32 is integrated with the isolator 20. This integration to the isolator 20 fixes the inductive loop 32 into a fixed position in relation to the H-field and allows the isolator 20 to be attached directly to the filter 30 without any intervening cabling or nuts used for tuning. Instead, a much more simplified and efficient tuning mechanism has been devised that doesn't require any movement of the input loop 32. Embodiments of this tuning mechanism are discussed in more detail below.

In the preferred embodiment the input loop 32 will be fixed in relation to the H-field, which will provide coupling to the H-field while using the minimum amount of loop. If the input loop 32 is fixed perpendicularly to the H-field, the coupling will be at a maximum. This fixing of the position of the input loop 32 contrasts with prior art uses of input loops which allowed the loop to be moved as part of the method of tuning the filter. According to the present invention the input loop 32 is fixed to achieve the coupling, preferably a maximum, and then uses only changes in capacitance or inductance, as discussed below, to tune the filter 30.

FIG. 3 shows the placement of the input loop 32 within the filter cavity 39. The first end 32a of the loop 32 is integrated in the isolator 20, wherein it receives the RF-signal, while the second end 32*b* of the loop 32 forms a capacitance 37 with a screw 36 attached to the upper boxwall 35*a*. In most prior uses of such inductive loops 32 the second end 32*b* of the loop 32 was attached to the ground, see "G" in FIG. 2. The aforementioned U.S. patent did disclose the idea of using a capacitance between the second end 32*b* and the ground, although the method of creating the capacitance, and the idea of keeping the input loop 32 fixed, is new in the present invention.

Figure 4:
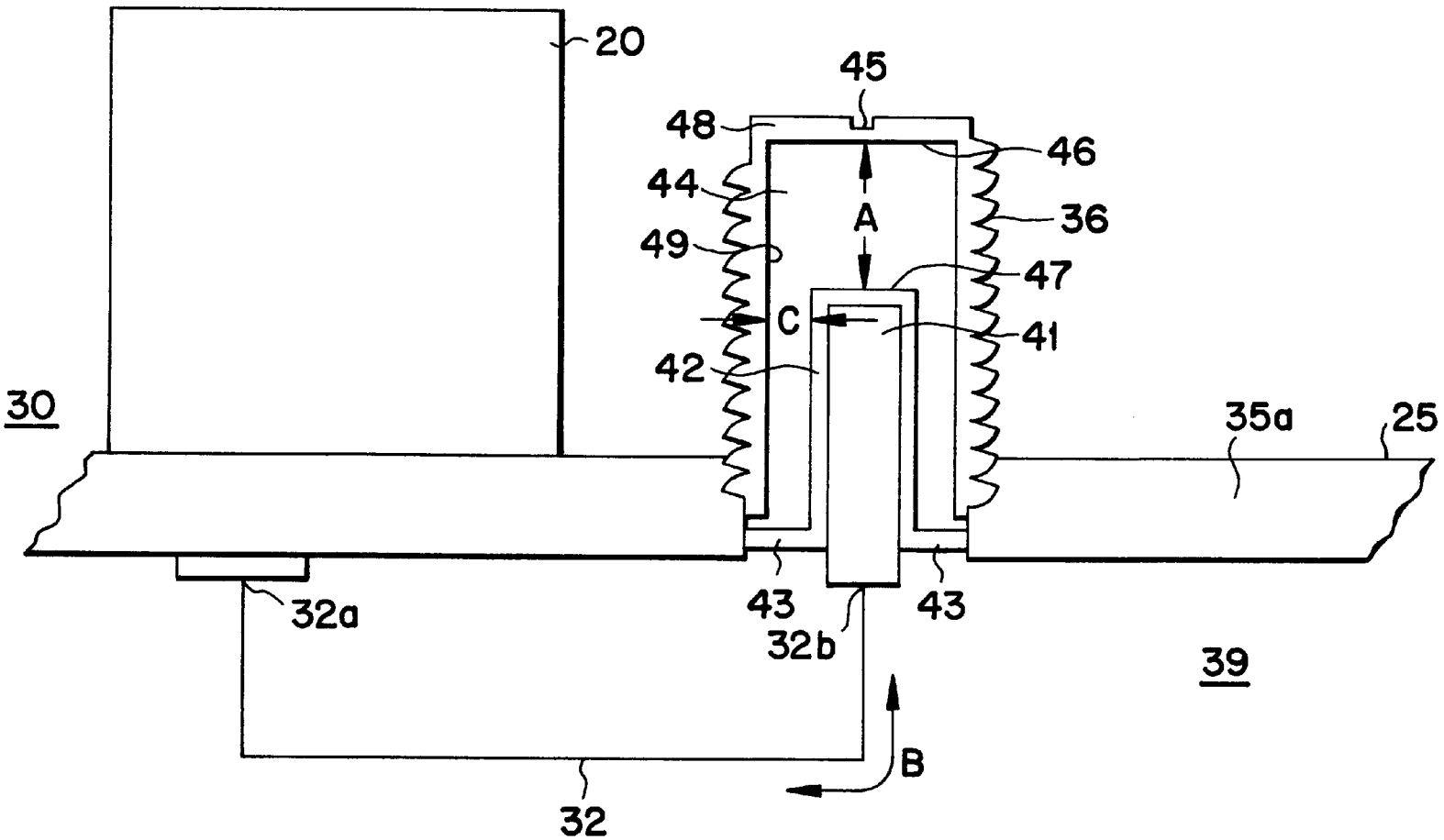
FIG. 4 illustrates a cutaway view of the preferred embodiment of the present invention used for tuning the filter by adjusting the capacitance in the input loop.

In FIG. 4 is shown a more detailed cutaway view of the structure used for creating the capacitance, 37 FIG. 3, used for tuning the filter 30 in the present invention. The upper boxwall 35*a*, input loop 32, and screw 36 here correspond with those shown in FIG. 3. The lower boxwall 35*b* of FIG. 3 is not shown here in FIG. 4 for practical reasons. Again, the upper boxwall 35*a* will have an electrically conductive surface with an interior that may be electrically conductive or formed of a nonconductive material, e.g. plastic.

As can be seen, the input loop 32 is fixed in relation to the H-field and will not be moved once it is fixed. The determination of the size of the input loop 32 and its relation to the resonant cavity 39 will be done in advance, depending on the frequency chosen to be filtered. However, once its size and position have been determined, no other changes in the size or position will need to be made to tune the filter 30.

The second end 32*b* of the input loop 32 is attached to an electrically conductive, preferably metal, shaft 41 which is also surrounded by a dielectric, e.g. a plastic covering 42. This plastic covering 42 also has lateral extensions 43 which attach to the upper boxwall 35*a*. These plastic lateral extensions 43 help keep the position of the input loop 32 fixed in relation to the H-field. This plastic cover 42 and electrically conductive shaft 41 combination is situated inside a dielectric-filled cavity 44 inside the screw 36. This dielectric may be a gas, such as air, or any other suitable dielectric or combination of dielectrics.

The screw 36 will be formed of some electrically conductive material, preferably metal. The placement of the electrically conductive screw 36 and the electrically conductive shaft 41 will thereby create a capacitance. The plastic covering 42 over the electrically conductive shaft 41 and the dielectric in the screw cavity 44 will both form dielectrics which will affect the capacitance between the electrically conductive shaft 41 and the screw 36.

Another factor affecting the capacitance between the screw 36 and the electrically conductive shaft 41 is the distance, as indicated by arrow "A", between the upper surface 47 of the electrically conductive shaft 41 and the inner surface 46 of the screw cap 48. This distance A can be adjusted by turning the screw 36 so that the inner surface 46 of the screw cap 48 either gets closer or further from the upper surface 47 of the electrically conductive shaft 41, depending on the direction of screw 36 rotation. Another factor affecting the capacitance between the screw 36 and the electrically conductive shaft 41 is the distance, as indicated by arrow "C", between the side inner surface 49 of the screw 36 and the electrically conductive shaft 41. This distance remains more or less constant as the screw 36 is adjusted.

This adjustment of the screw 36 is what used to tune the filter 30. In prior methods either the input loop 32 was moved to adjust its relation to the H-field to tune the filter 30, or it was moved in conjunction with the use of a variable capacitor, as in the aforementioned U.S. patent. In those prior approaches that didn't use a capacitor between the second end 32*b* and the ground had their maximum current node in the input loop 32 located at the ground. By adjusting the capacitance as in the present invention, the maximum current node is moved along the input loop 32 as indicated by arrow "B".

Thus, it can be seen that by fixing the input loop 32 into its, preferably maximum, coupling with the H-field, the tuning procedure is simplified to merely adjusting the capacitance by turning the screw 36. Finally, after the filter 30 is tuned, the screw 36 is locked into place using a self-locking mechanism in the screw, or by other means such as glue, adhesive, and other equivalent means known in the art.

Figure 5:
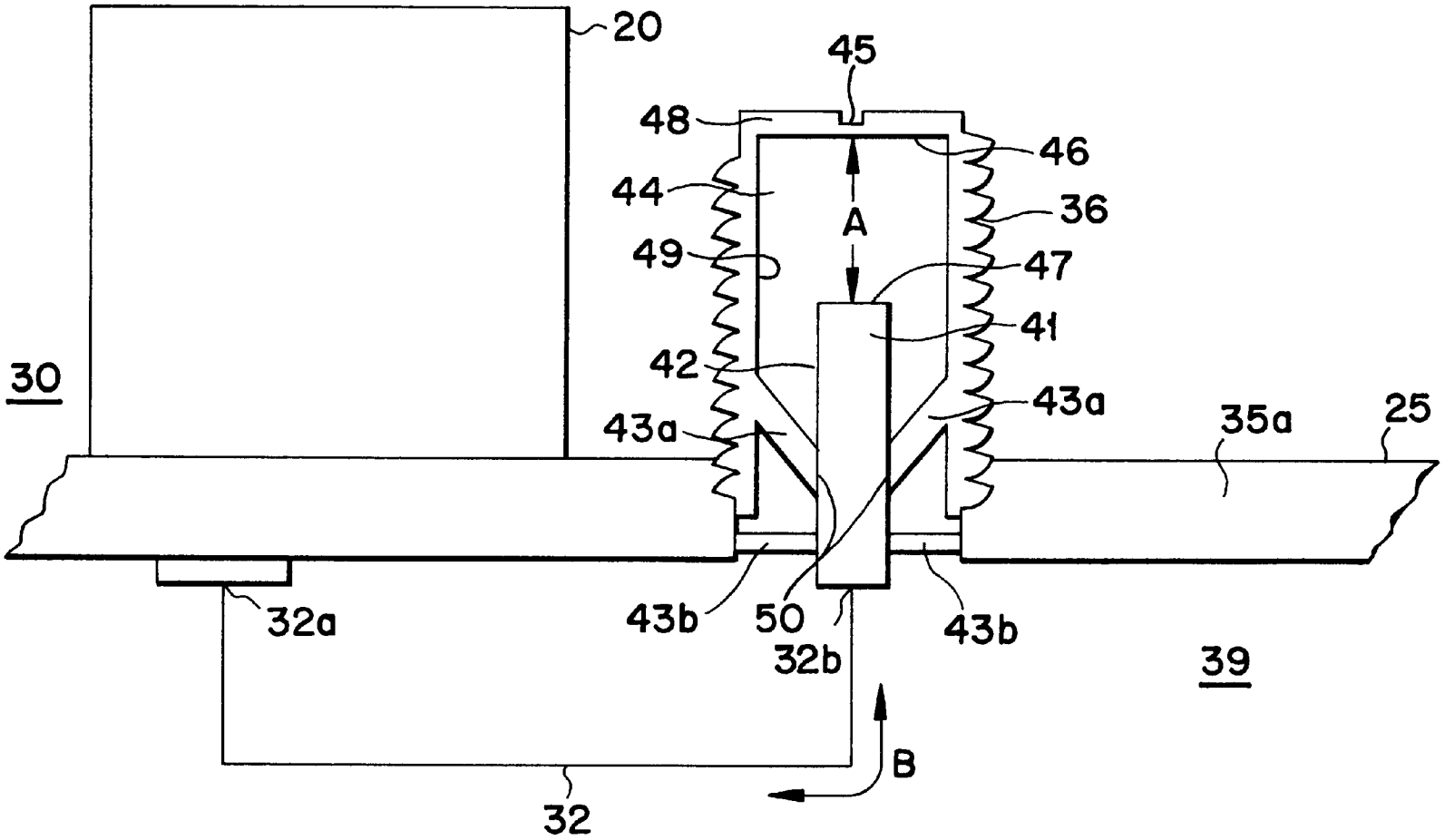
FIG. 5 illustrates a cutaway view of an alternative embodiment of the present invention used for tuning the filter by adjusting the inductance in the input loop.

A second embodiment of the present invention is shown in FIG. 5. The relation of the input loop 32 in relation to the upper boxwall 35*a* and the isolator 20 and screw 36 are the same as in FIG. 4. However, in this embodiment the inductance of the input loop 32 is used, rather than a capacitance, to tune the filter 30. In this embodiment the second end 32*b* of the loop 32 again is attached to an electrically conductive shaft 41. The inner surface 49 of the screw 36 then has electrically conductive extensions 43*a* which extend to, and touch, the electrically conductive shaft 41. It is also possible for the electrically conductive extensions 43*a* to be a part of the electrically conductive shaft 41 and thereby extend to, and touch, the inner surface 49 of the screw 36.

The electrically conductive shaft 41 also has dielectric, e.g. plastic, extensions 43*b* which are used to fix the electrically conductive shaft 43 to the upper boxwall 35*a*. When the screw 36 is rotated, the position of the point 50 at which the electrically conductive extensions 43*a* touch the electrically conductive shaft 41 is shifted. This shift in the contact point 50 along the electrically conductive shaft 41 effectively changes the point at which the electrically conductive shaft 41, and therefore the input loop 32, become grounded. This change in the effective length of the input loop 32 changes the inductance of the input loop 32, thereby shifting the maximum current node in the input loop 32 which, in turn, changes the bandwidth of the RF-signal passed by the filter 30.

The embodiments described above serve merely as illustration and not as limitation. It will be apparent to one of ordinary skill in the art that departures may be made from the embodiments described above without departing form the spirit and scope of the invention. Therefore, the invention should not be regarded as being limited to the examples described, but should be regarded instead as being equal in scope to the following claims.

What is claimed is:

1. A resonating filter, said resonating filter having an adjustable filter mechanism, said resonating filter having a resonating chamber with electrically conductive walls, said resonating filter also being grounded, said resonating chamber having a magnetic field and an electrically conductive input loop placed inside said resonating chamber, said electrically conductive input loop having a first end for receiving radio frequency signals and a second end characterized by said electrically conductive input loop being placed into a fixed position in relation to said magnetic field, and said adjustable filter mechanism being an adjustable capacitance being created by the positioning of said second end of said input loop relative to said ground of said resonating filter (30), wherein said resonating filter is provided with a hollow electrically conductive screw filled with a dielectric, said hollow electrically conductive screw having an inner surface, said second end of said input loop is placed inside said hollow screw adjacent to said inner surface, and said capacitance being formed by a combination of said dielectric inside said screw and said placement of said second end of said input loop in proximity to said inner surface of said hollow screw.

2. The filter of claim 1 characterized by said fixed position of said input loop being perpendicular to said magnetic field.

3. The filter of claim 1 characterized by said second end of said input loop being attached to an electrically conductive shaft said electrically conductive shaft being covered with a dielectric covering, and said capacitance be in a formed by the placement of said electrically conductive shaft inside said hollow screw and said capacitance being dependent upon the dielectric formed by said dielectric covering, said dielectric inside said hollow screw, and the distance between said electrically conductive shaft and said inner surface of said hollow screw.

4. The filter of claim 3 characterized by said dielectric covering being formed from plastic and said dielectric inside said hollow screw being air.

5. The filter of claim 3 characterized by said dielectric covering also forming extensions connecting said electrically conductive shaft to one of said electrically conductive walls, thereby fixing said second end of said input loop in relation to said resonating filter.

6. The filter of claims 1 characterized by one of said electrically conductive walls of said filter having an outer surface, an isolator attached to said outer surface, and said first end of said electrically conductive input loop being integrated within said isolator.

7. A resonating filter, said resonating filter having an adjustable filter mechanism, said resonating filter having a resonating chamber with electrically conductive walls, said resonating filter being grounded, said resonating chamber having a magnetic field and an electrically conductive input loop placed inside said resonating chamber, said electrically conductive input loop having a first end for receiving radio frequency signals and a second end, characterized by said electrically conductive input loop being placed into a fixed position in relation to said magnetic field, and said adjustable filter mechanism being an adjustable inductance being created by the positioning of said second end of said electrically conductive input loop relative to said ground of said resonating filter, wherein said resonating filter is provided with a hollow electrically conductive screw, said hollow electrically conductive screw having an inner surface, said second end of said electrically conductive input loop being placed inside said hollow electrically conductive screw adjacent to said inner surface, electrically conductive extensions being placed so as to contact both said inner surface and said input loop at a contact point near said second end of said input loop, and said inductance being formed by adjusting location of said contact point of said electrically conductive extensions along the length of said input loop.

8. The filter of claim 7 characterized by said fixed position of said electrically conductive input loop being perpendicular to said magnetic field.

9. The filter of claim 7 characterized by said second end of said input loop being attached to an electrically conductive shaft, said electrically conductive extensions being placed so as to contact both said inner surface and said electrically conductive shaft, said inductance being formed by adjusting the location of said contact point of said electrically conductive extensions along the length of said electrically conductive shaft.

10. The filter of claim 9 characterized by said electrically conductive shaft having dielectric extensions connecting said electrically conductive shaft one of said electrically conductive walls, thereby fixing said second end of said input loop in relation to said resonating chamber.

11. The filter of claim 7 characterized by one of said electrically conductive walls of said filter having an outer surface, an isolator attached to said outer surface and said first end of said input loop being integrated within said isolator.

* * * * *